US011051598B2

(12) United States Patent
Grunberger

(10) Patent No.: US 11,051,598 B2
(45) Date of Patent: Jul. 6, 2021

(54) MAGNETIC CLOSURE, PARTICULARLY FOR BAGS, RUCKSACKS AND THE LIKE

(71) Applicant: S.T.E.G.I. S.R.L., Milan (IT)

(72) Inventor: Andrea Grunberger, Milan (IT)

(73) Assignee: S.T.E.G.I. S.R.L., Milan (IT)

( * ) Notice: Subject to any disclaimer, the term of this patent is extended or adjusted under 35 U.S.C. 154(b) by 0 days.

(21) Appl. No.: 16/322,150

(22) PCT Filed: Jul. 31, 2017

(86) PCT No.: PCT/IB2017/054647
§ 371 (c)(1),
(2) Date: Jan. 31, 2019

(87) PCT Pub. No.: WO2018/025154
PCT Pub. Date: Feb. 8, 2018

(65) Prior Publication Data

US 2019/0174894 A1 Jun. 13, 2019

(30) Foreign Application Priority Data

Aug. 1, 2016 (IT) ..... 102016000080448

(51) Int. Cl.
*A45C 13/10* (2006.01)

(52) U.S. Cl.
CPC ..... *A45C 13/1069* (2013.01)

(58) Field of Classification Search
CPC ..... A45C 13/1069
See application file for complete search history.

(56) References Cited

U.S. PATENT DOCUMENTS 4,458,396 A * 7/1984 Aoki ..... A45C 13/1069 24/303
4,736,494 A * 4/1988 Marchesi ..... A41F 1/002 24/303
5,473,799 A * 12/1995 Aoki ..... A45C 13/1069 24/303

(Continued)

FOREIGN PATENT DOCUMENTS

CN 86 1 08815 A 6/1987
CN 88 2 01461 U 11/1988

(Continued)

OTHER PUBLICATIONS

International Search Report and Written Opinion dated Oct. 6, 2017 issued in PCT/IB2017/054647.

(Continued)

*Primary Examiner* — Jason W San
(74) *Attorney, Agent, or Firm* — Scully, Scott, Murphy & Presser, P.C.

(57) ABSTRACT

A magnetic closure, particularly for bags, rucksacks and the like, comprising a male element adapted to accommodate a magnet or ferromagnetic element, and a female element; the male element can be associated with a first flap of a bag, rucksack or the like, and the female element is associable with a second flap of the bag, rucksack or the like; the male element comprises an enclosure with a cavity for accommodating the magnet or ferromagnetic element, the enclosure being adapted to mate in a cavity of the female element.

9 Claims, 7 Drawing Sheets

(56) References Cited

U.S. PATENT DOCUMENTS 5,675,874 A * 10/1997 Chen ..... A41F 1/002 24/303
6,131,247 A * 10/2000 Morita ..... A45C 13/1069 24/303
6,163,938 A * 12/2000 Weber-Unger ..... A41F 1/002 24/303
6,170,131 B1 * 1/2001 Shin ..... A41F 1/002 24/303
6,182,336 B1 * 2/2001 Bauer ..... A41F 1/002 24/303
6,857,169 B2 * 2/2005 Chung ..... A44B 11/258 24/303
7,251,865 B2 * 8/2007 Takamura ..... A44B 1/08 24/113 MP
8,505,174 B2 * 8/2013 Fildan ..... A41F 1/002 24/303
8,720,016 B2 * 5/2014 Beaulieu ..... F16B 21/073 24/457
9,392,829 B2 * 7/2016 Manuello ..... A41F 1/002
9,517,712 B1 * 12/2016 Masanek, Jr. ..... B60N 3/044
9,839,263 B2 * 12/2017 Villa ..... A44B 17/0023
10,165,811 B2 * 1/2019 O'Leary ..... A41D 27/08
10,470,529 B2 * 11/2019 Chan ..... A44B 11/2592
10,484,522 B1 * 11/2019 McHatet ..... H04B 1/3888
10,617,179 B2 * 4/2020 Fiedler ..... A44B 11/12
2002/0152590 A1 * 10/2002 Lin ..... A41F 1/002 24/303
2003/0024079 A1 * 2/2003 Morita ..... A45C 13/1069 24/303
2012/0044031 A1 * 2/2012 Ninomiya ..... A44B 11/2596 335/219
2012/0124786 A1 * 5/2012 Fiedler ..... A45C 13/1069 24/303
2015/0135486 A1 * 5/2015 Fiedler ..... A44B 11/2584 24/303
2015/0296910 A1 * 10/2015 Nelson ..... A41F 1/002 24/303
2015/0313319 A1 * 11/2015 Ha ..... A43C 11/165 24/303
2016/0186789 A1 * 6/2016 Nelson ..... F16B 1/00 24/303
2017/0172262 A1 * 6/2017 Paik ..... A44B 11/2592
2017/0354208 A1 * 12/2017 Park ..... A44B 17/0082
2018/0125167 A1 * 5/2018 You ..... A45C 13/10
2018/0132570 A1 * 5/2018 Chen ..... A41F 1/002

FOREIGN PATENT DOCUMENTS

CN 1206490 A 1/1999
CN 203302459 U 11/2013
CN 103945728 A 7/2014
EP 3 165 117 A1 5/2017
WO WO 2013/031628 A1 3/2013
WO WO-2013031628 A1 * 3/2013 ..... A45C 13/1069
WO 2015/109316 A1 7/2015

OTHER PUBLICATIONS

Italian Search Report dated Mar. 16, 2017 issued in IT 2016000080448, with partial translation.
European Examination Report dated Feb. 11, 2020 received in European Patent Application No. 17 764 645.2.
Chinese Office Action dated Mar. 30, 2020 received in Chinese Patent Application No. 201780060005.5.

* cited by examiner

MAGNETIC CLOSURE, PARTICULARLY FOR BAGS, RUCKSACKS AND THE LIKE

The present invention relates to a magnetic closure, particularly for bags, rucksacks, and the like. More particularly, the invention relates to a magnetic closure with a reduced number of components.

As is known, for bags, rucksacks and the like magnetic closures have been known for decades which comprise a male element that can be coupled to a first flap of a bag, for example, and a female element that can be coupled to a second flap of the bag, with at least one magnet arranged at the male element or at the female element and a ferromagnetic element at the other one of said male or female elements.

The coupling between the male element and the female element occurs following the mutual approach of the two flaps to which the male element and the female element are respectively coupled.

However, magnetic closures of the known type have some drawbacks, for example if one wishes to provide an extremely thin closure so that the two flaps essentially fit together.

The aim of the present invention is to provide a magnetic closure, particularly for bags, rucksacks and the like, in which the male element and the female element of the magnetic closure are provided by means of a reduced number of components.

Within this aim, an object of the present invention is to provide a magnetic closure, in which the coupling between the male element and the female element of the magnetic closure provides a magnetic closure of reduced thickness with respect to magnetic closures of the known type.

Another object of the present invention is to provide a magnetic closure in which the male element is prevented from rotating inside the female element.

Another object of the present invention is to provide a magnetic closure that is highly reliable, relatively simple to provide and at competitive costs.

This aim, as well as these and other objects which will become better apparent hereinafter, are achieved by a magnetic closure, particularly for bags, rucksacks and the like, comprising a male element adapted to accommodate a magnet or ferromagnetic element, and a female element, said male element being associable with a first flap of a bag, rucksack or the like, and said female element being associable with a second flap of said bag, rucksack or the like, said male element being associable in a seat formed in said female element, characterized in that said male element comprises an enclosure with a cavity for accommodating said magnet or ferromagnetic element, said enclosure being adapted to mate in a cavity of said female element.

Further characteristics and advantages of the invention will become better apparent from the description of preferred but not exclusive embodiments of the magnetic closure according to the present invention, illustrated by way of nonlimiting example in the accompanying drawings, wherein.

Figure 1:
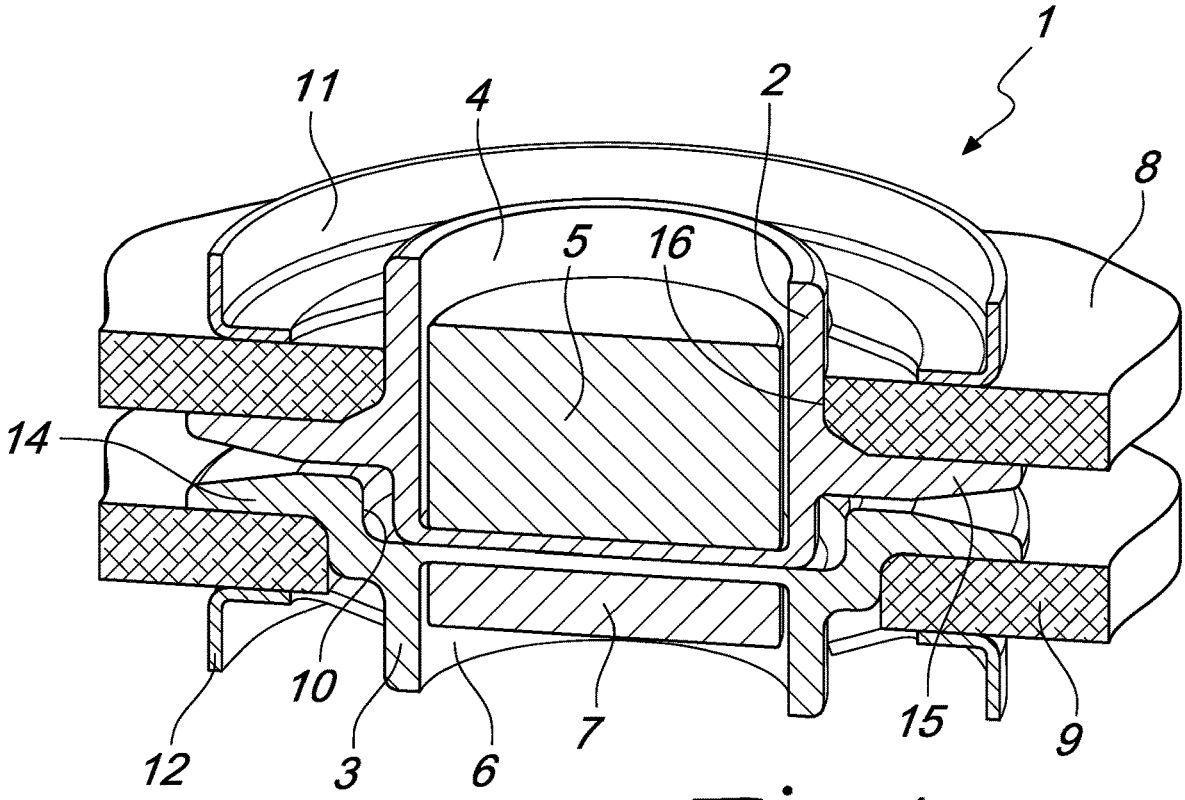
FIG. 1 is a perspective view of a first embodiment of the magnetic closure according to the present invention.
Figure 3:
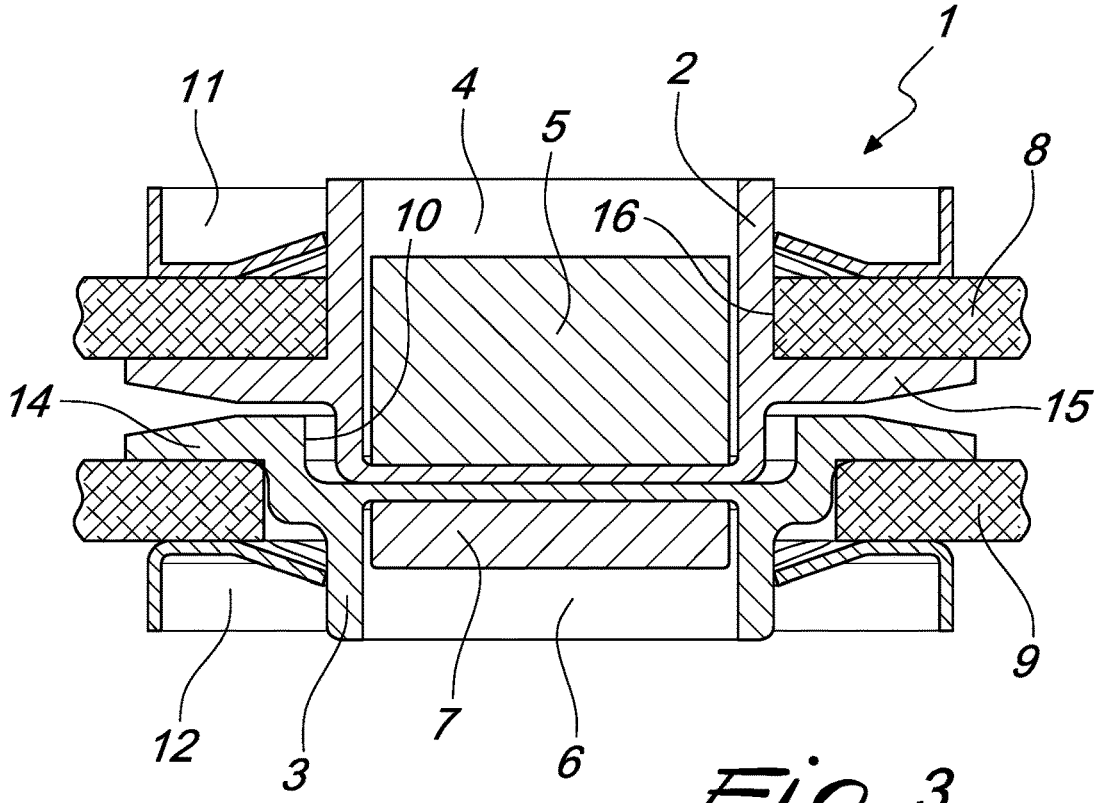
FIG. 3 is a transverse sectional view of the magnetic closure of FIGS. 1 and 2.
Figure 2:
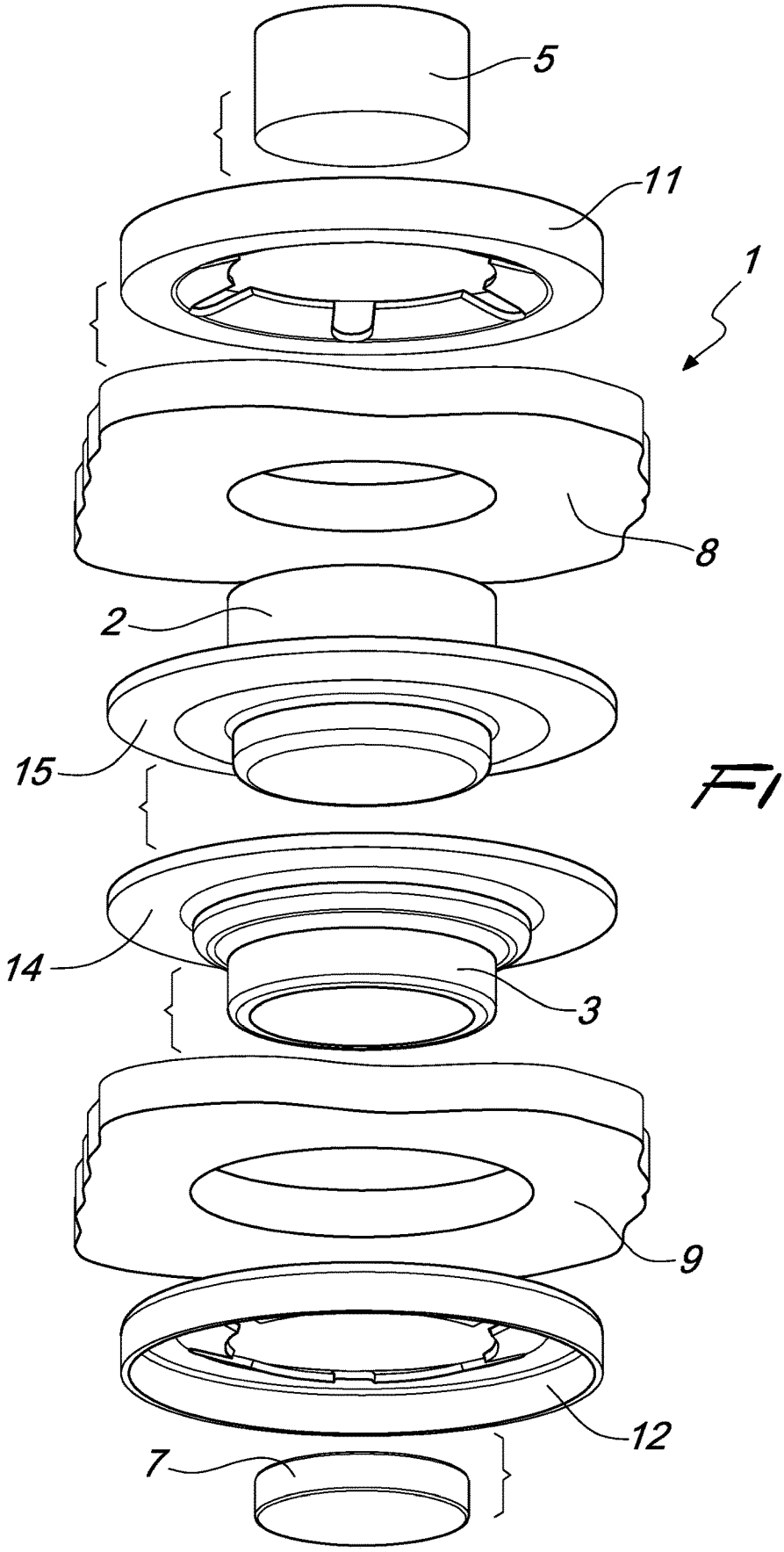
FIG. 2 is an exploded perspective view of the magnetic closure of FIG. 1.

With reference to the figures, the magnetic closure according to the invention, designated generally by the reference numeral 1, comprises, in a first embodiment, shown in FIGS. 1 to 3, a male element 2 and a female element 3. The male element comprises an enclosure provided with a cavity 4 to accommodate a magnet 5. Likewise, the female element can have an enclosure with a cavity 6 that is adapted to accommodate a magnet 7 or a ferromagnetic element. It is of course possible to provide both the male element and the female element with magnets 5 and 7.

As an alternative, the female element can be itself a ferromagnetic element, provided with a cavity and adapted to couple with the magnet of the male element.

The male element is adapted to be applied to a first flap 8 of a bag, rucksack or the like, and the female element is adapted to be applied to a second flap 9 of a bag, rucksack or the like.

The male element 2 has the particularity that the seat 4 for accommodating the magnet or ferromagnetic element enters the female element 3 for coupling between the male element 2 and the female element 3.

The male element 2 is shaped so that the seat 4 for accommodating the magnets 5 or ferromagnetic element is such as to allow the accommodation of the magnet 5 or ferromagnetic element. It is therefore the magnet 5 or ferromagnetic element that passes through the first flap 8 and couples within the female element 3.

The female element 3 is provided with a cavity 6 that is formed so as to accommodate the magnet 7 or ferromagnetic element so that it straddles the second flap 9.

If instead the female element is itself the ferromagnetic element, the cavity 6 is not present.

The female element 3 is provided with a cavity 10 for accommodating the male element, said cavity being arranged either flush with the second flap 9 or so as to slightly straddle the second flap 9.

In this manner, the coupling between the male element 2 and the female element 3 allows to have a distance between the flaps 8 and 9 that is extremely reduced and therefore a magnetic closure of reduced thickness.

Both the male element and the female element are constituted by a maximum number of two components.

A sealing ring 11 for the male element and a retention ring 12 for the female element, each constituted by an elastic locking ring which is fitted around the seat 4 of the male element, which protrudes from the first flap 8 and around the seat 6 of the female element that protrudes from the second flap 9, allow to fix and retain the male element and the female element to the first flap 8 and to the second flap 9, respectively, without requiring other fixing elements.

In the first embodiment, shown in FIGS. 1 to 3, the first flap 8 is such that the seat 4 of the male element 2 is in contact with the flap 8, with the seat 4 of the male element provided with a flange 15 which forms a right angle with the seat 4, so as to accommodate the flap 8.

Figure 4:
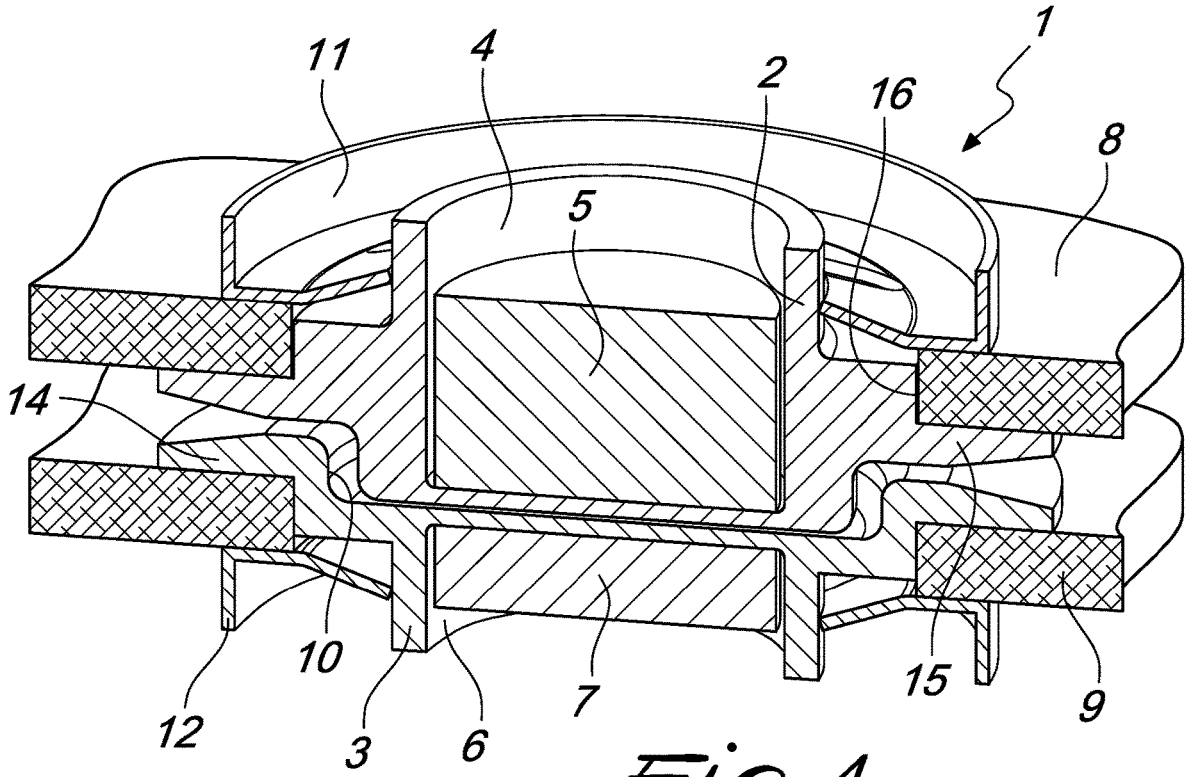
FIG. 4 is a perspective view of a second embodiment of the magnetic closure according to the invention.
Figure 6:
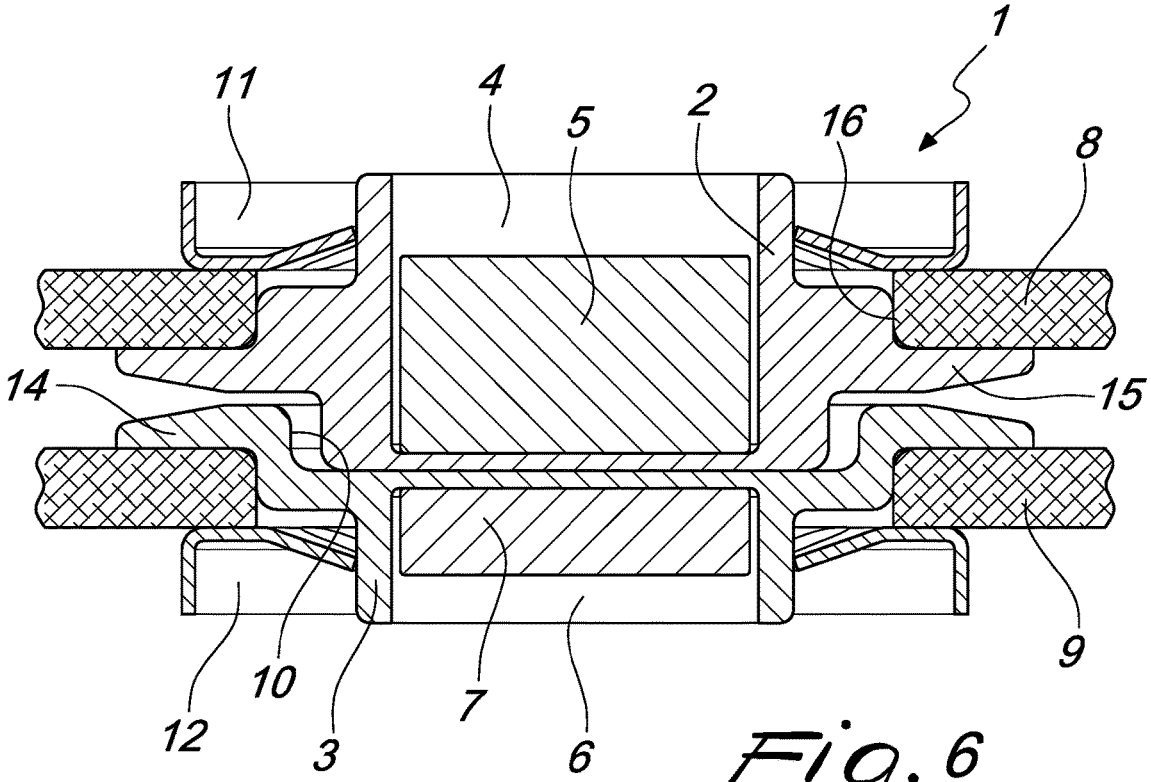
FIG. 6 is a transverse sectional view of the magnetic closure of FIGS. 4 and 5.
Figure 5:
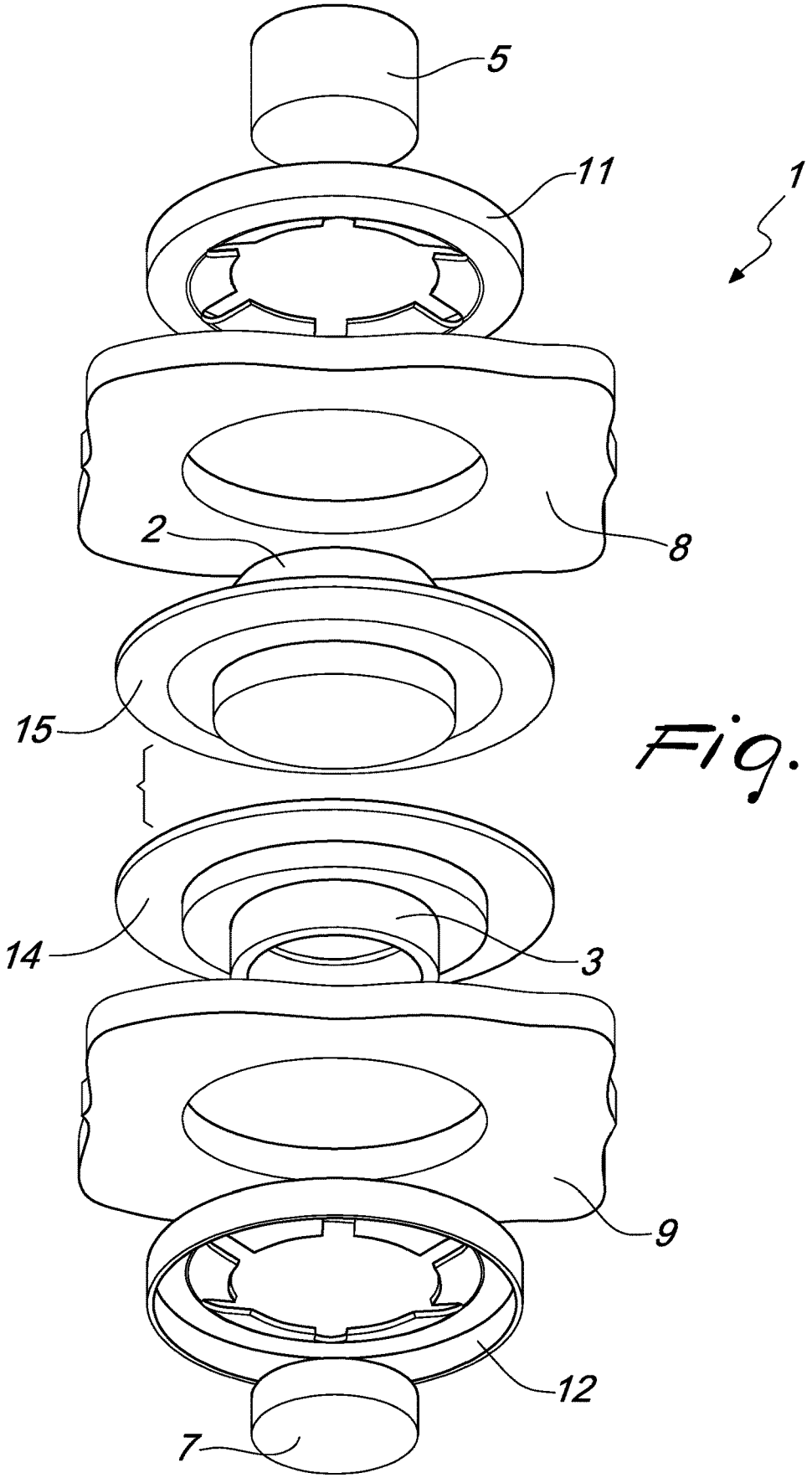
FIG. 5 is an exploded perspective view of the magnetic closure of FIG. 4.
Figure 7:
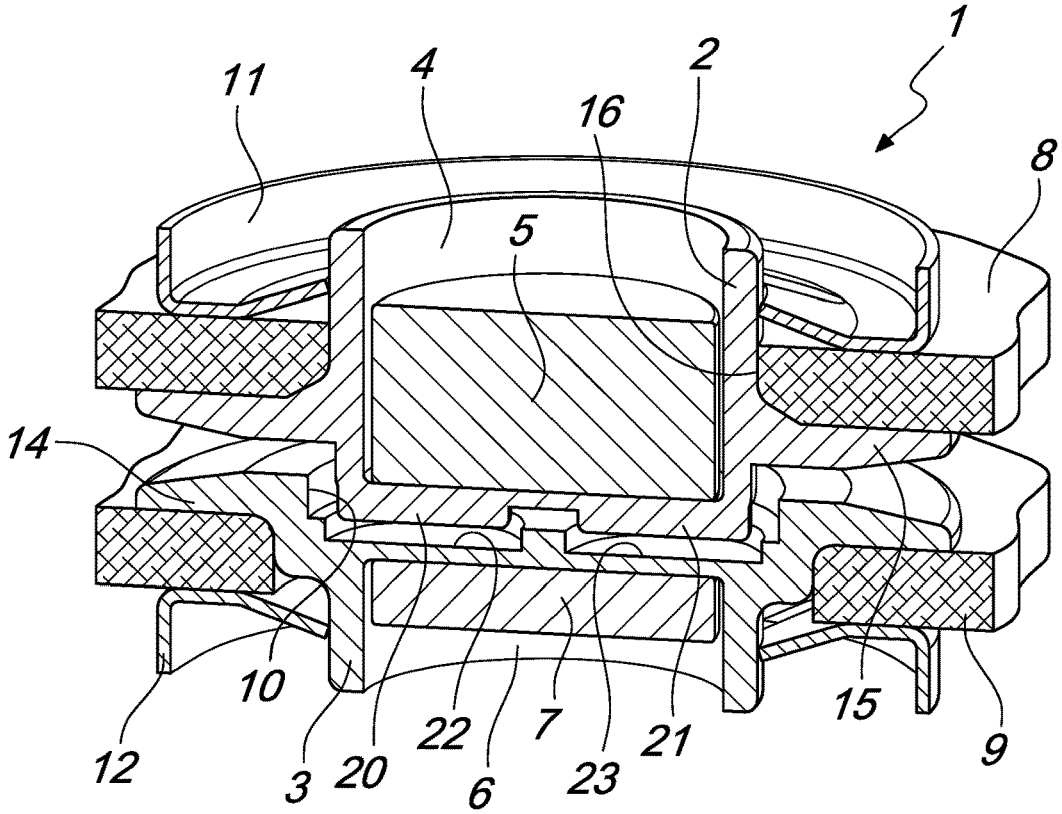
FIG. 7 is a cutout perspective view of a third embodiment of the magnetic closure according to the present invention.
Figure 10:
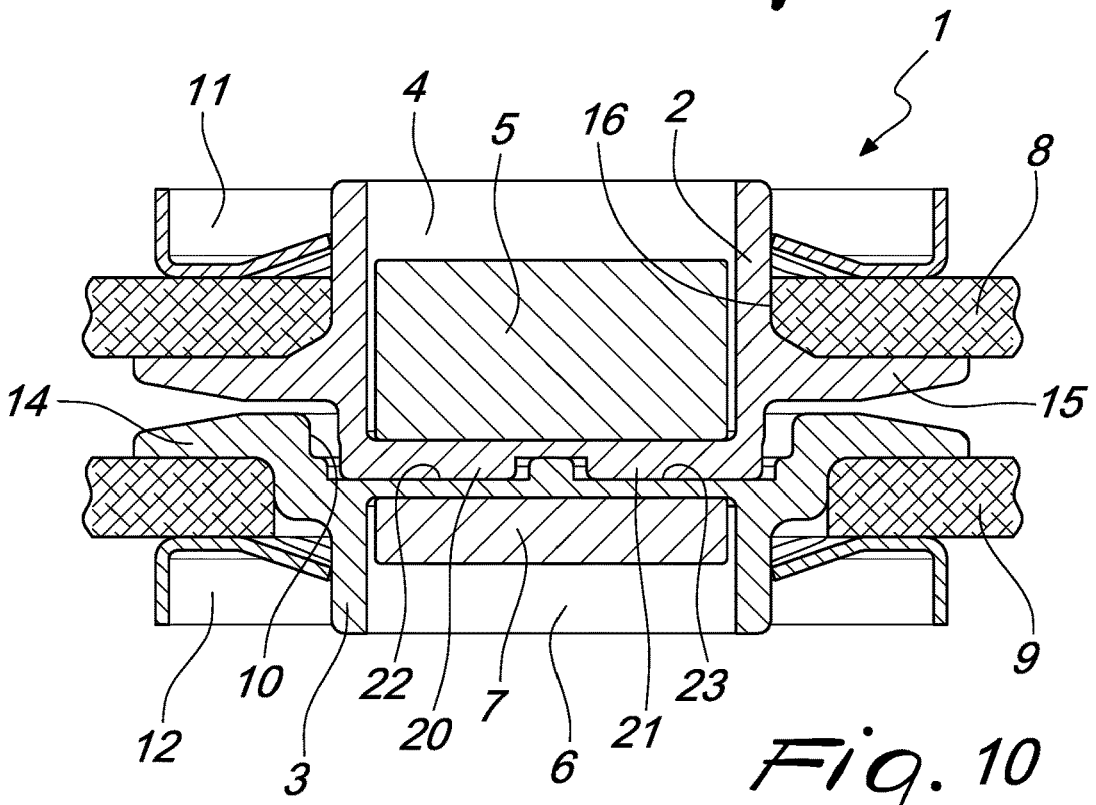
FIG. 10 is a transverse sectional view of the magnetic closure of FIGS. 7, 8 and 9.
Figure 8:
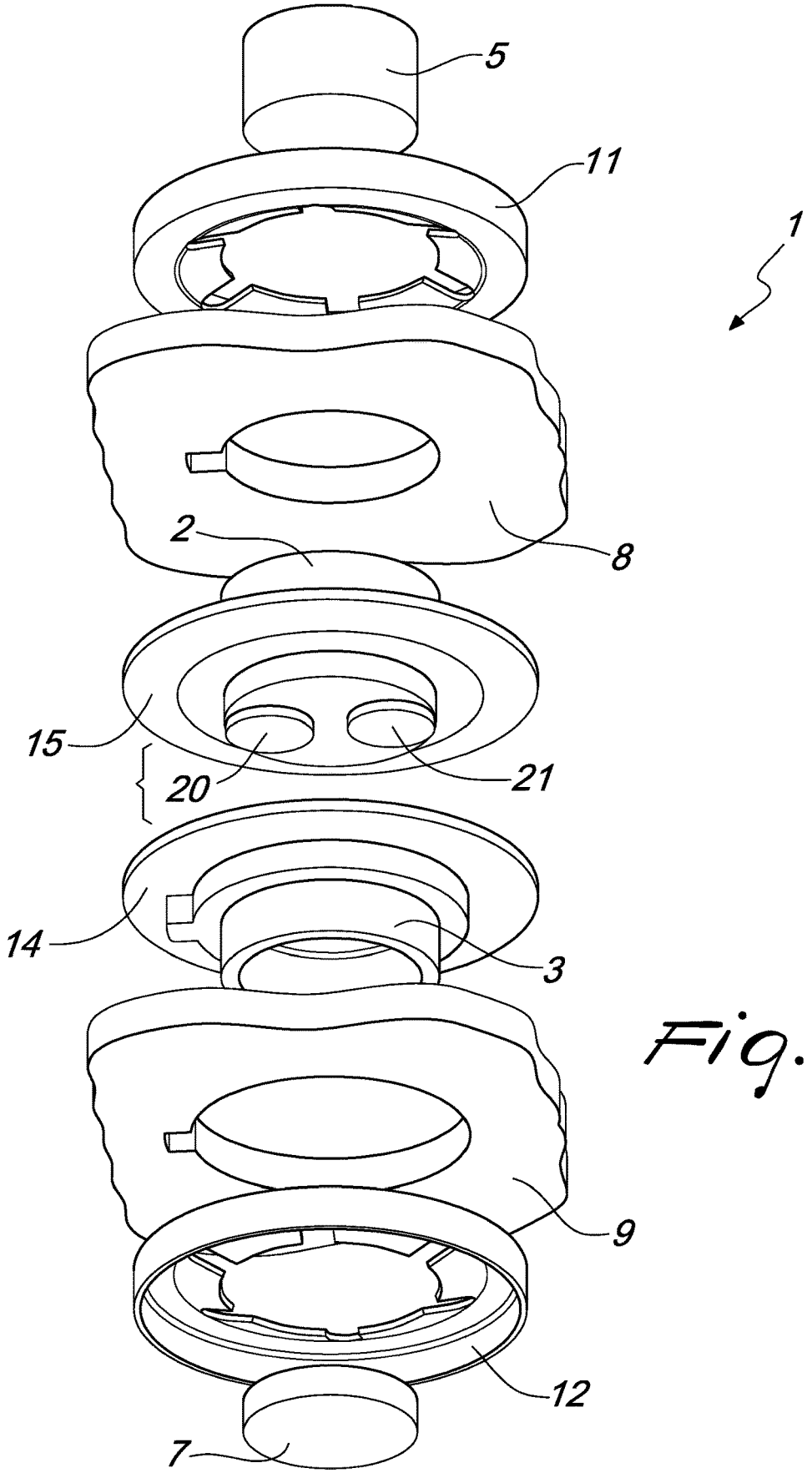
FIG. 8 is an exploded perspective view of the magnetic closure of FIG. 7.
Figure 9:
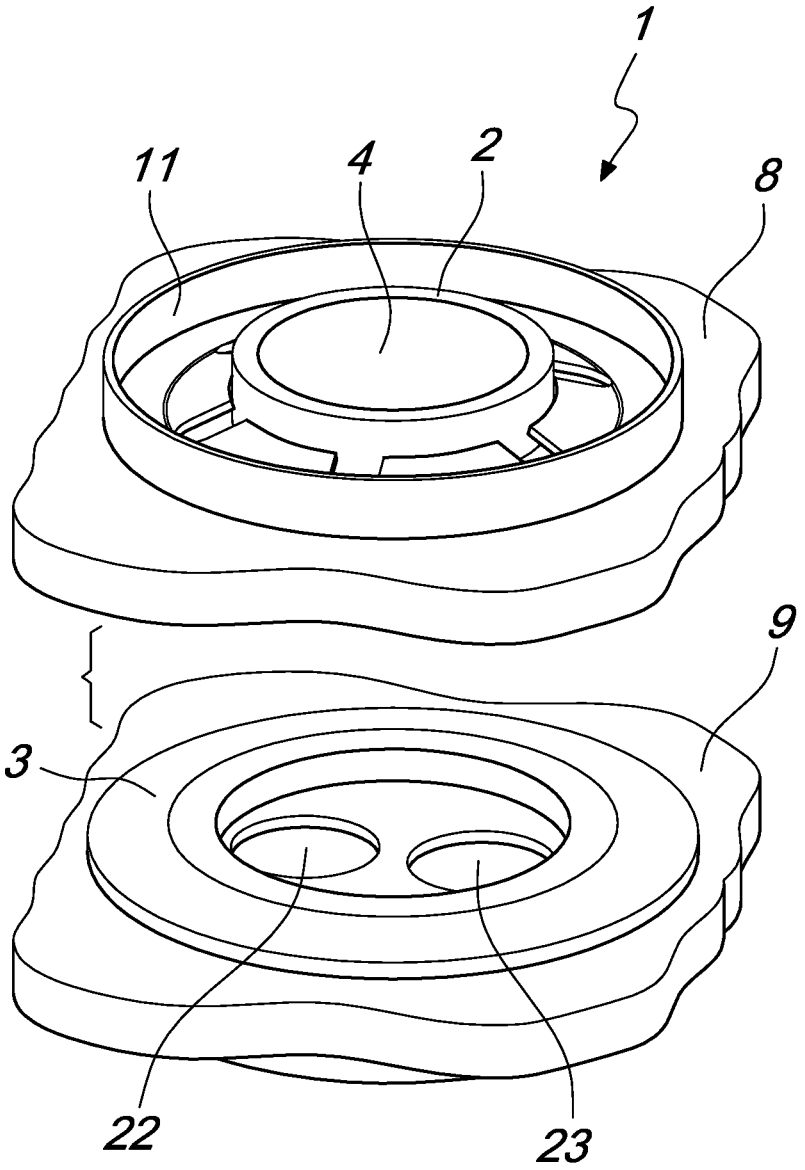
FIG. 9 is an exploded perspective view of a detail of the magnetic closure of FIGS. 7 and 8.

In the second embodiment, shown in FIGS. 4 to 6, the flange 15 of the male element 2 is instead provided with a recess 16 which forms a step that accommodates the first flap 8.

In the third embodiment, instead, the flange 15 is provided with a profile that blends with a curvilinear portion with the seat 4 of the male element and consequently accommodates the first flap 8.

In this third embodiment, the male element has the outer lower surface provided with at least two protruding portions 20 and 21 which engage in corresponding seats 22 and 23 of the female element 3 so as to prevent a rotation of the male element within the female element when the two elements are mutually coupled.

Both the male element and the female element are provided monolithically as regards the cavity and the corresponding flanges that allow coupling with the flap 8 and the flap 9.

In practice it has been found that the magnetic closure according to the invention achieves fully the intended aim and objects, since can be provided with the male element monolithically as regards the cavity for accommodating the magnet or ferromagnetic element, with retention of the male element by means of an elastic retention ring and, likewise, the female element is provided, as regards the cavity for accommodating the magnet or ferromagnetic element, also monolithically and is retained by means of an elastic ring used in a similar manner for the male element.

The reduced number of components of the magnetic closure is combined with a reduced thickness of said magnetic closure.

The magnetic closure thus conceived is susceptible of numerous modifications and variations, all of which are within the scope of the appended claims.

All the details may further be replaced with other technically equivalent elements.

In practice, the materials used, as well as the contingent shapes and dimensions, may be any according to the requirements and the state of the art.

The disclosures in Italian Patent Application no. 102016000080448 (UA2016A005688), from which this application claims priority, are incorporated herein by reference.

The invention claimed is:

1. A magnetic closure, comprising:

a male element and a magnet or a ferromagnetic element, the male element adapted to accommodate the magnet or ferromagnetic element;

a first flap of a bag and/or a rucksack;

a second flap of the bag and/or the rucksack; and a female element, wherein said male element configured to couple to the first flap, wherein said first flap comprises a first surface and a second surface, the second surface opposite to the first surface, and said female element configured to couple to the second flap, wherein said male element comprises an enclosure with a cavity configured to accommodate said magnet or ferromagnetic element, said enclosure adapted to mate in a cavity of said female element, wherein each of said cavity of the male element and said magnet or ferromagnetic element extend through an opening in the first flap, and wherein each of said cavity of the male element and said magnet or ferromagnetic element extend across both the first surface and the second surface; and wherein the cavity of the male element comprises a bottom surface that separates the magnet of the male element from the female element.

2. The magnetic closure according to claim 1, wherein said female element is a ferromagnetic element.

3. The magnetic closure according to claim 1, wherein said female element accommodates a magnet or ferromagnetic element.

4. The magnetic closure according to claim 1, wherein said male element is provided in a maximum number of two pieces with the cavity for said magnet or ferromagnetic element.

5. The magnetic closure according to claim 1, wherein said male element and said female element are fixed to said first flap and said second flap respectively by means of a locking ring which is adapted to be fitted around the cavity of said male element and said female element that is adapted to accommodate said magnet or ferromagnetic element.

6. The magnetic closure according to claim 1, wherein said magnet or ferromagnetic element of said female element, accommodated within said cavity of said female element, is arranged so as to straddle said second flap.

7. The magnetic closure according to claim 1, wherein said cavity of said female element has a lower surface that is substantially flush with said second flap when said female element is coupled to said second flap.

8. The magnetic closure according to claim 1, wherein said male element has an outer lower surface provided with a pair of protruding portions adapted to engage in respective seats formed within said cavity of said female element.

9. The magnetic closure according to claim 5, wherein said locking ring of said male element and of said female element is an elastic ring with flexible wings adapted to fasten around the outer surface of the cavity of said male element and of said female element.

* * * * *